United States Patent [19]

Speckhart et al.

[11] 4,456,383

[45] Jun. 26, 1984

[54] DRAG RACE REACTION TIMER

[76] Inventors: Frank H. Speckhart, 534 Dellwood Dr., Knoxville, Tenn. 37919; Dennis W. Higdon, 7709 Brickyard Rd., Powell, Tenn. 37849

[21] Appl. No.: 426,674

[22] Filed: Sep. 29, 1982

[51] Int. Cl.[3] ..... G04B 47/00; G04F 8/00

[52] U.S. Cl. ..... 368/9; 368/10; 368/107; 368/110

[58] Field of Search ..... 368/1, 2, 9, 10, 107, 368/108, 110

[56] References Cited

U.S. PATENT DOCUMENTS 402,291 4/1889 Adams ..... 368/2

2,388,387 11/1945 Cohen ..... 368/9

3,054,614 9/1962 Dean ..... 368/9

3,643,158 2/1972 Kroner et al. ..... 368/2

*Primary Examiner*—Bernard Roskoski

[57] ABSTRACT

A drag race reaction timer including a displacement measuring means comprising a roller contained within a housing and a switch operable upon contact with said roller. Circuitry is provided to activate yellow and green lamps simulating the start of a drag race and to determine the time difference between the appearance of the green lamp and displacement of the auto by a predetermined distance. If the auto moves the predetermined distance before the appearance of the green light, a red light is activated.

7 Claims, 5 Drawing Figures

DRAG RACE REACTION TIMER

In drag racing, losers and winners are usually separated by only hundredths of a second so the outcome of many races is determined as much by the skill of the drivers at the starting line as by the performance of their cars. In typical drag races, cars may cross the starting line only after a green light has been illuminated. If a driver crosses the line before the green light comes on, he is said to have "red-lighted" and automatically loses. Thus, to win drivers strive to cross the starting line as soon as possible after the green signal is illuminated. Typically, prior to the race, each car is positioned from about one to eight inches behind the starting line and at least one yellow light glows for a fixed period of time prior to the green light appears. In so-called "Pro" racing, a single yellow light is illuminated for four-tenths of second before the green light. If a so-called "five-tenths start" is to be used, just prior to the green light, five yellow lights appear in sequence with each being illuminated for five-tenths of a second. Thus drivers attempt to set their car in motion so that it will cross the starting line as soon as possible after the green light comes on. As serious drag racers are constantly modifying their cars, changing gears, tires, weight distributions and the like, they should practice after each change since the starting response of the car changes with each modification. The apparatus of the present invention makes it possible for a driver to practice starting so that he can reduce the probability of "red lighting" while minimizing the time lost crossing the starting line.

DESCRIPTION OF THE PREFERRED EMBODIMENT

Figure 1:
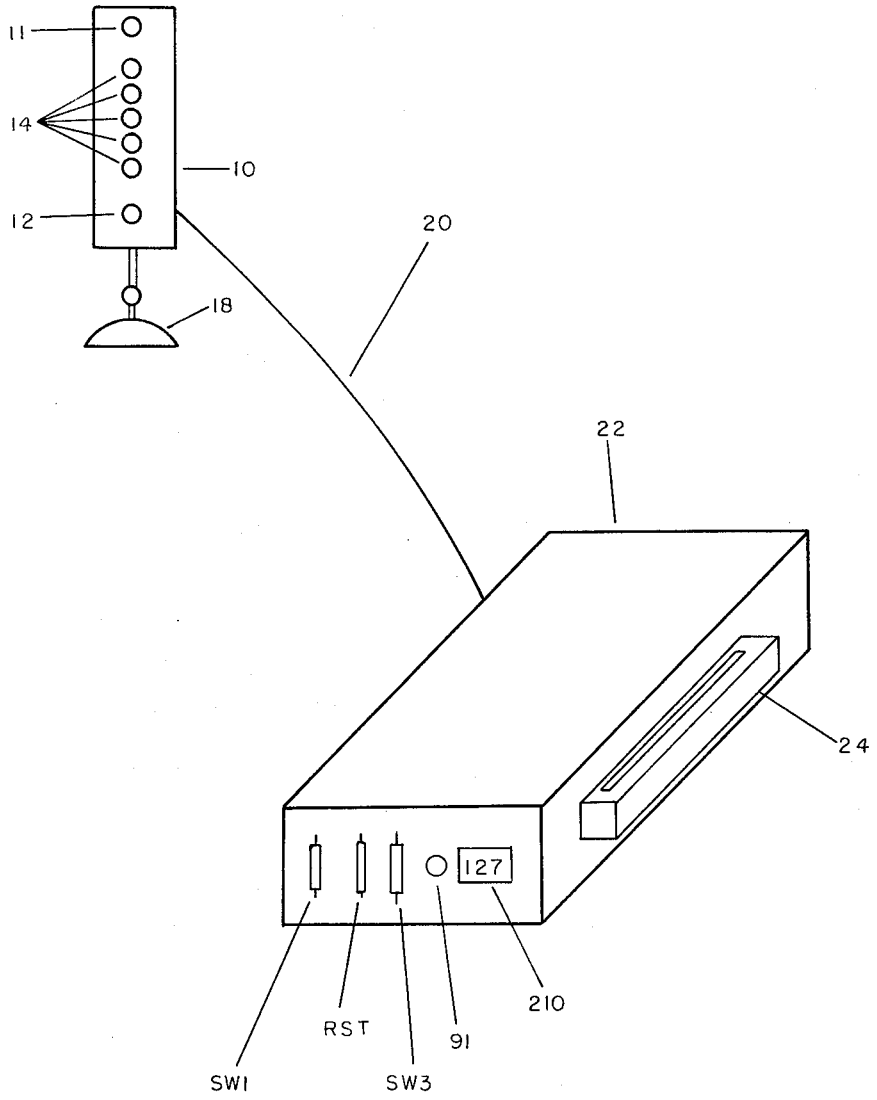
FIG. 1 illustrates the external appearance of a reaction timer according to the present invention wherein the displacement measuring device is attached directly to the console containing the electronic circuitry.
Figure 2:
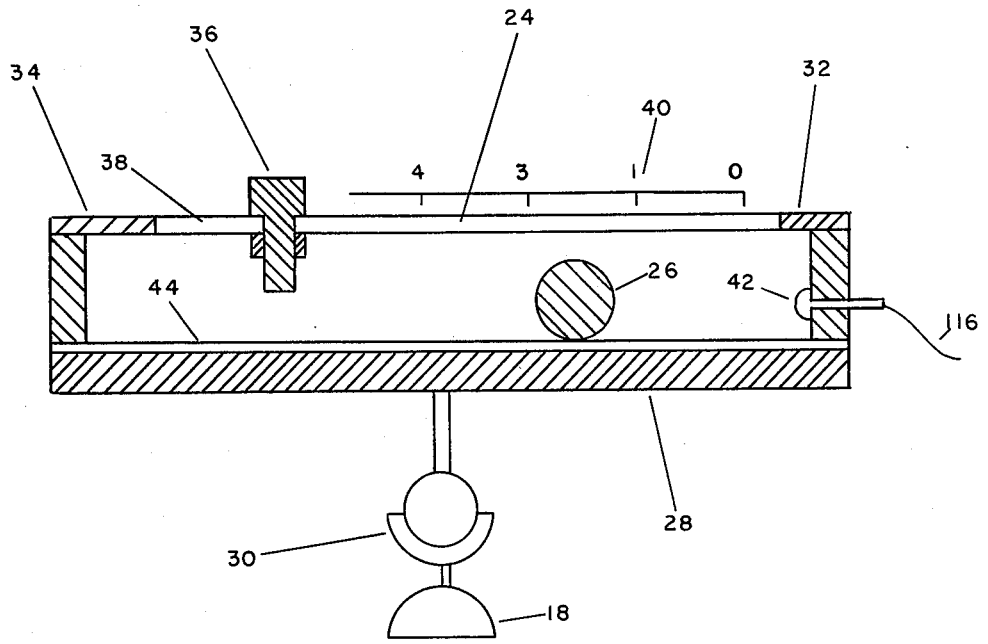
FIG. 2 is a schematic cross-sectional view of displacement measuring device according to the present invention.
Figure 3:
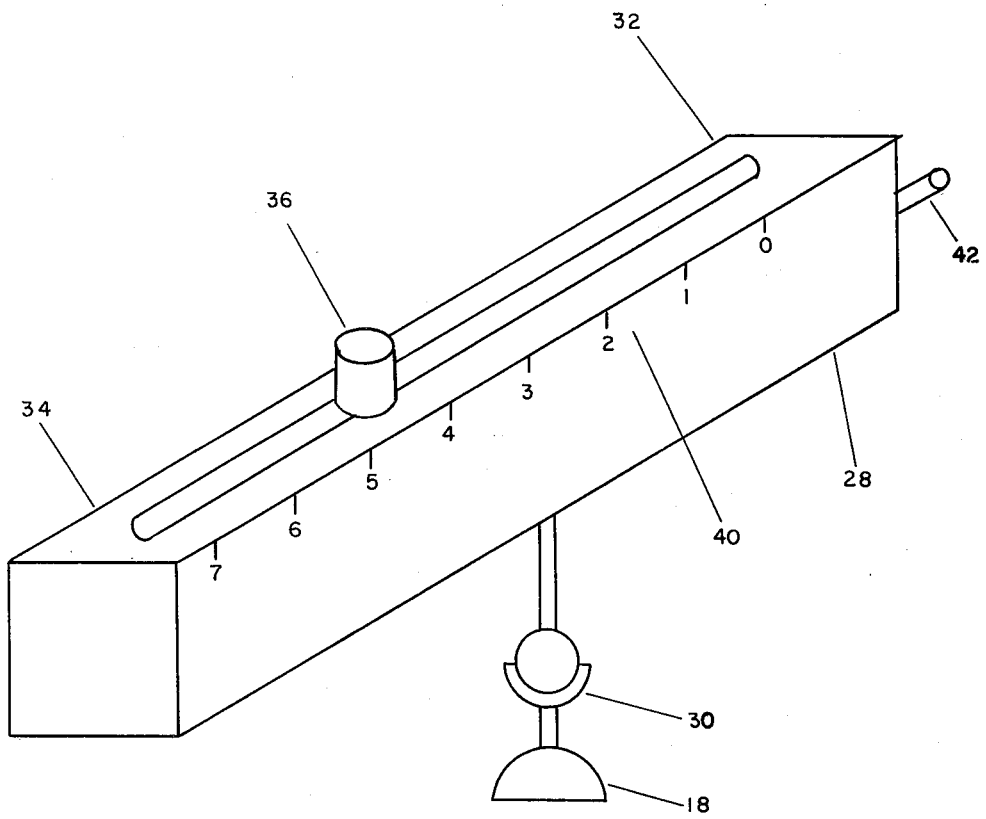
FIG. 3 is a perspective view of a displacement measuring device according to the present invention wherein the device is detached from the console housing the electronic circuitry.

Light display 10 has mounted thereon one green lamp 12, 5 yellow lamp 14 and ready lamp 11. Suction cup and ball mechanism 18 serves as means to position light display 10 within the normal field of vision of the driver such as by mounting on a dashboard or windshield. Cables 20 serve to connect lamps 12, 14 and 11 to console 22. Displacement measuring device 24 as shown in FIGS. 2 and 3 comprises a roller such as sphere 26 within a housing such as tube 28. Displacement measuring means 24 may be mounted directly on console 22 as shown in FIG. 2 or may be detached as shown in FIG. 3. If detached, mounting means such as ball joint and suction cup 30 are provided so that the longitudinal axis of tube 28 may be more easily aligned with the direction of acceleration of the car with rear portion 32 of tube 28 being elevated very slightly with respect to forward portion 34 so that sphere 26 gently rests against moveable stop 36. Moveable stop 36 is confined within longitudinal slot 38 in tube 28 and may be adjustable positioned along the length of slot 38. Scale 40 is marked upon the exterior of tube 28 and is calibrated such that index position one is five-sevenths of an inch from rear contact 42, index position 2 is ten sevenths and so forth. If a cylinder rolling on a plane is substituted for sphere 26, then index position 1 is located two-thirds of an inch from rear contact 42, index position 2 is four thirds of an inch and so forth. If a roller with a more esoteric shape is to be used, the appropriate calibration factor C may be determined using the formula $$C = \frac{1}{1 + r/R}$$

where r is the radius of gyration and R is actual radius of the roller. Spheres are greatly preferred since they roll without binding. For a spere, $C=5/7$, $r/R=2/5$ and for a cylinder, $C=2/3$ while $r/R=1/2$.

To insure that sphere 26 rolls without slipping, the bottom of tube 28 is lined with sheet 44 of a material having a high coefficient of friction such as a fine grade of emery cloth or sandpaper or alternatively rubber.

One embodiment of the electronic circuitry suitable for properly sequencing the light emitting diode (LED) lights and for displaying elapsed time between the GREEN start light and achievement of the ROLL distance (or vice versa) will now be described in conjunction with FIGS. 4 and 5.

Figure 4:
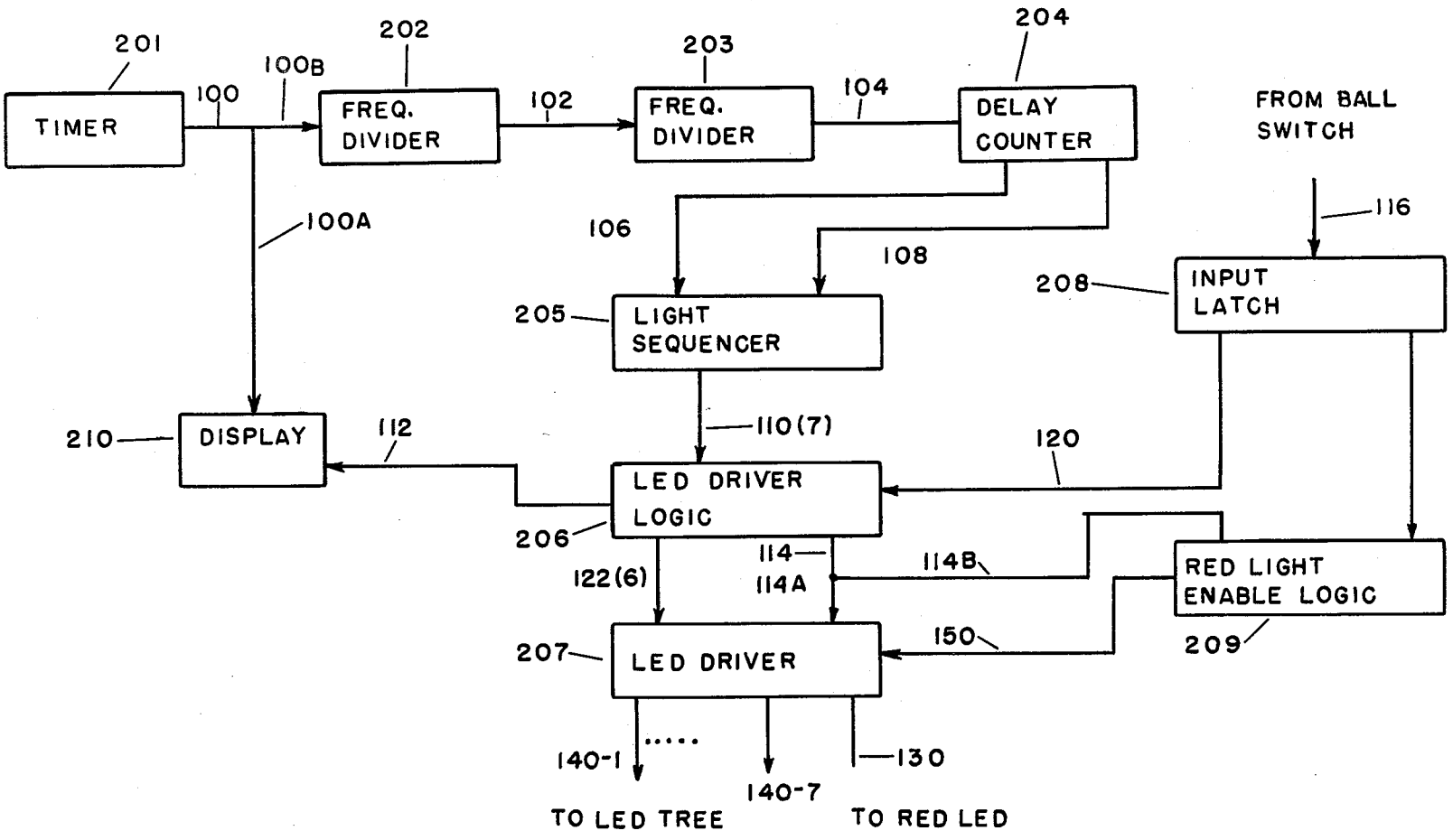
FIG. 4 is a functional block diagram of the logic circuitry of the reaction timer according to the present invention.

With reference to the functional block diagram of FIG. 4, timer 201 furnishes, for example, a 16 KHz pulse train at outpost 100 which is coupled via lead 100B to an input of frequency divider 202 and to a clock driving input of display 210 via lead 100A. An output of frequency divider 202 is coupled via lead 102 to an input of frequency divider 203 whose output is, in turn, coupled via lead 104 to an input of delay counter 204.

Two outputs of delay counter 204 are coupled via paths 106 and 108 to light sequencer 205. Seven output lines from sequencer 205, represented by bus 110, are coupled to logic circuitry 206.

Ball switch contact 42 (FIG. 2) is coupled via lead 116 to input latch 208. One output of latch 208 is coupled via path 120 to another input to logic circuitry 206, while a second output of latch 208 is coupled to RED light enable logic circuitry 209.

One output of logic circuitry 206 is coupled via lead 112 to an enabling input of display 210. A GREEN light enabling output from logic circuitry 206 is output on lead 114 and is coupled via path 114A to LED driver circuitry 207 and, via path 114B to RED light enable logic circuitry 209. Six other outputs of logic circuitry 206 (one each corresponding to a READY light and five yellow sequenced lights) are also coupled via bus 122 to LED driver circuitry 207. An output of RED light enabling logic circuitry 209 is coupled via lead 150 to LED driver circuitry 207. Outputs 140-1 through 140-7 of circuitry 207 are respectively coupled to a READY light, five yellow lights, and a GREEN, or start light, all such lights comprised of LEDs. Output 130 of circuitry 207 is coupled to a RED LIGHT, also comprised of an LED. Incandescent bulbs can be used in place of LEDs if desired.

The general operation of the embodiment set forth in FIG. 4 is as follows. Timer 201 generates a pulse train of a frequency suitable for driving display 210 such that each displayed digit (three total) will represent, for example, one millisecond. The pulse train furnished by timer 201 is also divided down by dividers 202 and 203 in conjunction with delay counter 204 to a frequency suitable for enabling light sequencer 205 to properly turn on the READY, yellow and GREEN LEDs via logic circuitry 206 and driver circuitry 207.

Logic circuitry 206 sends a signal via lead 112 to enable display 210 to begin counting (and displaying) a time period, in milliseconds, whenever either a signal is received via lead 120 from latch 208 indicating that the ROLL distance has been reached, or a signal from light sequencer 205 indicating that the GREEN start LED is being turned on. Whenever both signals are present, i.e., GREEN light activation plus ROLL distance achieved, the counter in display 210 is stopped. In this manner, the time period between GREEN light activation and ROLL distance achievement is registered at display 210. This time period is displayed whichever signal occurs first.

RED light enable logic circuitry 209 operates on an output signal from latch 208 on lead 118 and on a GREEN light activation signal on lead 114B determine whether the displacement transducer, or ball switch, has been activated prior to initiation of GREEN light turn-on. If such is the case, logic circuitry 209 will enable, via lead 150, a RED light indicative of a false start.

As will be apparent to those of ordinary skill in the art, the functional blocks of the exemplary embodiment of FIG. 4 may be implemented in a variety of approaches. One such approach is set forth in the circuit diagram of FIG. 5. Leads and components in FIG. 5 corresponding to the same leads and functional blocks of FIG. 4 given identical numerical designations.

Figure 5:
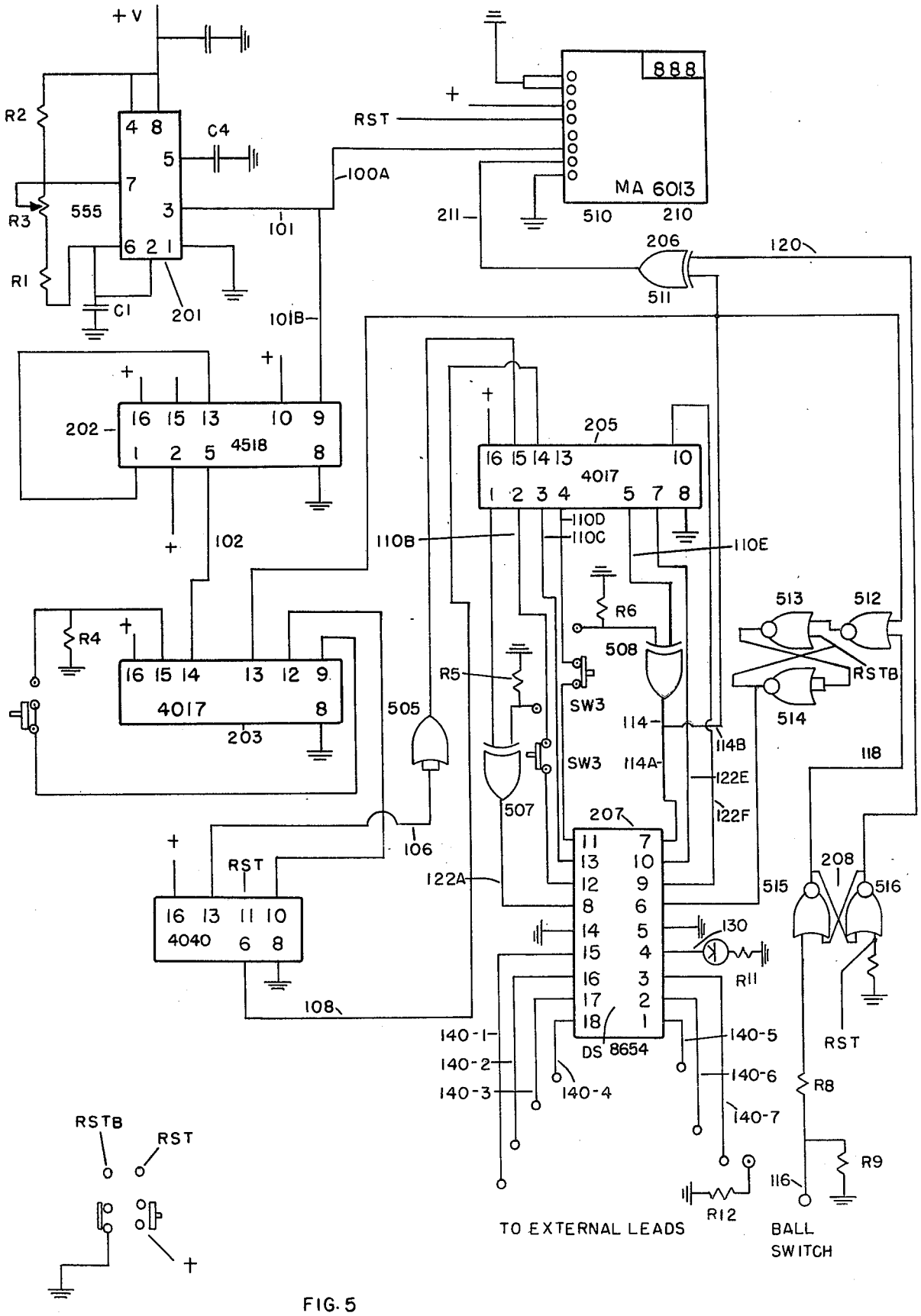
FIG. 5 is a circuit diagram setting forth more detail of corresponding functional blocks of FIG. 4.

As seen from FIG. 5, timer 201 could comprise a type 555 commercially available integrated circuit (IC) timer unit. With IC pin connections as shown, timer 201 will output a 16 KHz pulse train to display 210, which may comprise IC type MA-6013, and to divider 202, which may comprise IC type 4518.

With the pin interconnections shown in FIG. 5, divider 202 will convert the 16 KHz signal on lead 100B to a 160 Hz signal on lead 102 for presentation to divider 203. Divider 203 may comprise IC type 4017, and, with the pin connections shown, divider 203 will place either a 20 Hz (for PRO start) or a 16 Hz (for five tenths start) signal on lead 104, depending upon the setting of slide switch SW3. With switch SW3 positioned as shown in FIG. 5, the circuitry is arranged to simulate a so-called Five Tenths start via the LEDs.

The preselected 16 Hz or 20 Hz signal is coupled to an input of delay counter 204, which may comprise an IC type 4040 which, in turn, provides appropriate input clocking signals to sequencer 205 which may be comprised of an IC type 4017 decade counter.

Logic circuitry 206 of FIG. 4 may be comprised of contacts of switch SW3 and exclusive OR gates 507, 508 and 511, all configured as shown in FIG. 5.

RED light enable logic 209 of FIG. 4 may be comprised of NOR gates 512, 513 and 514, along with output RST-B of reset switch RST, all configured as shown in FIG. 5.

Input latch 208 of FIG. 4 may comprise a bistable electronic switch element fashioned from NOR gates 515 and 516, configured as shown in FIG. 5.

LED driver circuitry 207 could comprise an IC type DS 8654 with pin connections as shown in FIG. 5. All integrated circuit types shown in FIG. 5 are commercially available from a variety of sources, including National Semiconductor, Inc.

OPERATION

In operation, the driver places light display 10 within his field of vision then selector switch SW3 (FIG. 5) for either a "PRO" start or a "five tenths" start. Displacement measuring device 24 is placed with its longitudinal axis coinciding with the direction of acceleration of the car with rear portion 32 being very slightly higher than forward protion 34 so that sphere 26 rests against adjustable stop 36. With the aid of scale 40, adjustable stop 36 is located within longitudinal slot 38 at a distance corresponding to the desired distance from the starting line. For example, if the driver desires to start with his car eight inches behind the starting line, the adjustable stop is positioned adjacent to index 8 on scale 40 so that the rear surface of sphere 26 is located forty-sevenths of an inch from contact 42. Upon proper adjustment of the displacement measuring device 24, the driver then closes the activating switch SW1 causing (after a short interval) yellow lamp 14 to be illuminated for four-tenths of a second if a "Pro" start has been selected by the position of mode switch Sw3. As the driver causes the car to accelerate, sphere 26 rolls backwards against contact 42 and closes normally open switch 46. If normally open switch 46 was closed before green light 12 was activated, red light 91 is illuminated until reset switch RST (FIG. 5) is closed. If normally open switch 46 was closed after green light 12 was activated, then red light 91 is not activated. In either case, the difference in time between the activation of green light 12 and the closing of switch 46 appears upon display 210 (FIG. 4 or FIG. 5). If a "five tenths" start has been selected, the operation varies only in that upon closing of activating switch SW1, each of yellow lamps 14 glow in sequence for five tenths of a second after a short interval. To prepare for subsequent trials, the driver activates reset switch RST, ensures that roller 26 is resting against stop 36, and then activates ready switch SW1.

As my invention, I claim

1. A drag race reaction timer comprising:

a light display including a lamp of a first color, a lamp of a second color, and a signal means;

a displacement measuring means including a stop, a roller and a switch activateable by contact with said roller;

means for activating said lamp of said first color for a predetermined period of time, then activating said lamp of said second color at the end of said predetermined period; and means for activating said signal means if said switch is activated before said lamp of said second color is activated.

2. The drag race reaction timer of claim 1, further including:

four additional lamps of said first color; selector means capable of being maintained in a first mode and a second mode wherein at least one lamp of said first color is activated for substantially four-tenths of a second when said selector means is in said first mode and each of said lamps of said first color is activated in sequence at intervals of substantially five-tenths of a second when said selector is in second mode.

3. The apparatus of claim 2 wherein the position of said stop within said displacement measuring means by adjusted and further including means for displaying the time elapsed between activation of said switch and activation of said lamp of said second color.

4. The apparatus of claim 1 wherein the position of said stop within said adjustment measuring means may be adjusted and further including means for displaying the time elapsed between activation of said switch and activation of said lamp of said second color.

5. The apparatus of claim 4 wherein said first color is yellow, said second color is green and said signal means includes a red lamp.

6. The apparatus of claim 3 wherein said first color is yellow, said second color is green and said signal means includes a red lamp.

7. The apparatus of claim 1 wherein said first color is yellow, said second color is green and said signal means includes a red lamp.

* * * * *